US005131112A

United States Patent [19]

Cervini

[11] Patent Number: 5,131,112

[45] Date of Patent: Jul. 21, 1992

[54] GOLF PLAYER'S PERSONAL GOLF BALL AND EQUIPMENT CLEANING IMPLEMENT

[76] Inventor: Robert E. Cervini, P.O. Box 215, Bridgeton, N.J. 08302

[21] Appl. No.: 746,051

[22] Filed: Aug. 12, 1991

Related U.S. Application Data

[63] Continuation of Ser. No. 363,273, May 31, 1989.

[51] Int. Cl.[5] ..... A63B 57/00; A63B 47/04

[52] U.S. Cl. ..... 15/209.1; 15/208; 15/169; 15/104.94; 15/105

[58] Field of Search ..... 15/114, 208, 104.94, 15/118, 169, 168, 209 R, 209 C, 209 D, 105; 401/86, 18

[56] References Cited

U.S. PATENT DOCUMENTS

| | | | |
|---|---|---|---|
| 770,588 | 9/1904 | Koch . | |
| 1,563,031 | 11/1925 | Jones | 15/169 |
| 1,702,172 | 2/1929 | Rennie | 15/210 |
| 2,204,947 | 6/1940 | Apfelbaum | 15/208 |
| 2,530,746 | 11/1950 | Wetherly | 15/210 |
| 2,572,349 | 10/1951 | Kaplan | 15/210 R |
| 2,580,139 | 12/1951 | Twisdale | 15/168 |
| 3,095,593 | 7/1963 | Krasne | 15/234 |
| 3,350,736 | 11/1967 | Frazelle et al. | 15/209 R |
| 3,462,230 | 8/1969 | Beard | 15/104.94 |
| 3,806,983 | 4/1974 | Cunningham | 15/160 |
| 4,227,278 | 10/1980 | Raskin | 15/234 |
| 4,350,457 | 9/1982 | Carnahan | 401/11 |
| 4,516,616 | 5/1985 | Fesler | 15/209 R |

FOREIGN PATENT DOCUMENTS 511529 12/1953 Belgium .

*Primary Examiner*—Harvey C. Hornsby
*Assistant Examiner*—Patrick Brinson
*Attorney, Agent, or Firm*—Eugene E. Renz, Jr.

[57] ABSTRACT

A lightweight personal golf ball cleaner, ball marker, and club cleaner in a plastic casing or cylinder about the size of a 12-gauge shot gun shell, the interior of the cylinder having small towel means adapted for wetting before a golf round and means mounting the towel in such a manner that a twist of the cylinder will extend outwardly the towel to expose the towel for cleaning of a ball on a golf course putting green and when not in use, the towel can be twisted back into the cylinder. The implement is of a size whereby it can be clipped onto a golf player's belt, shirt pocket, golf bag and the like.

1 Claim, 3 Drawing Sheets

FIG.5
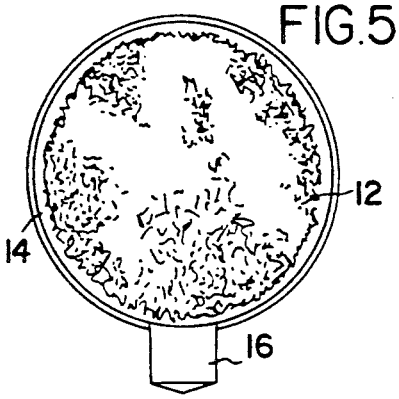
FIG.8
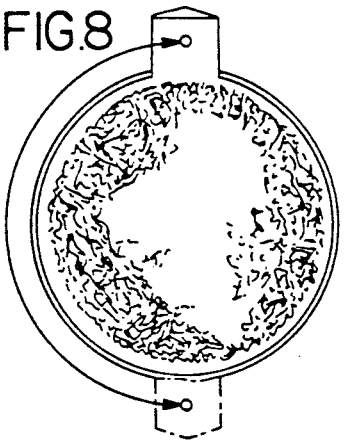
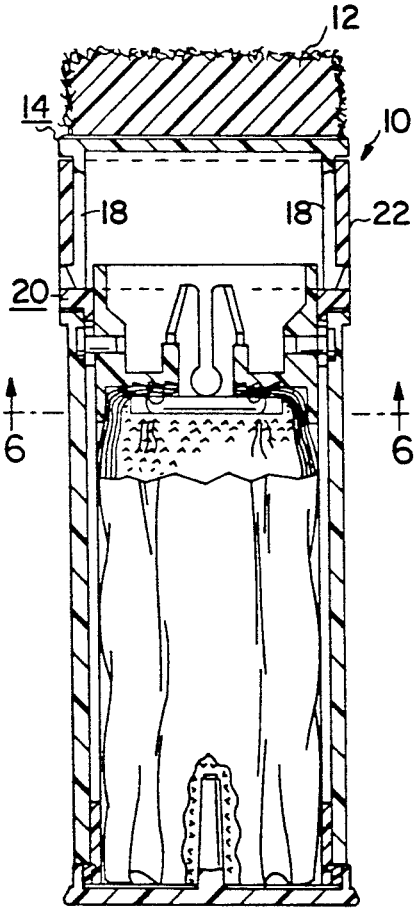
FIG.4
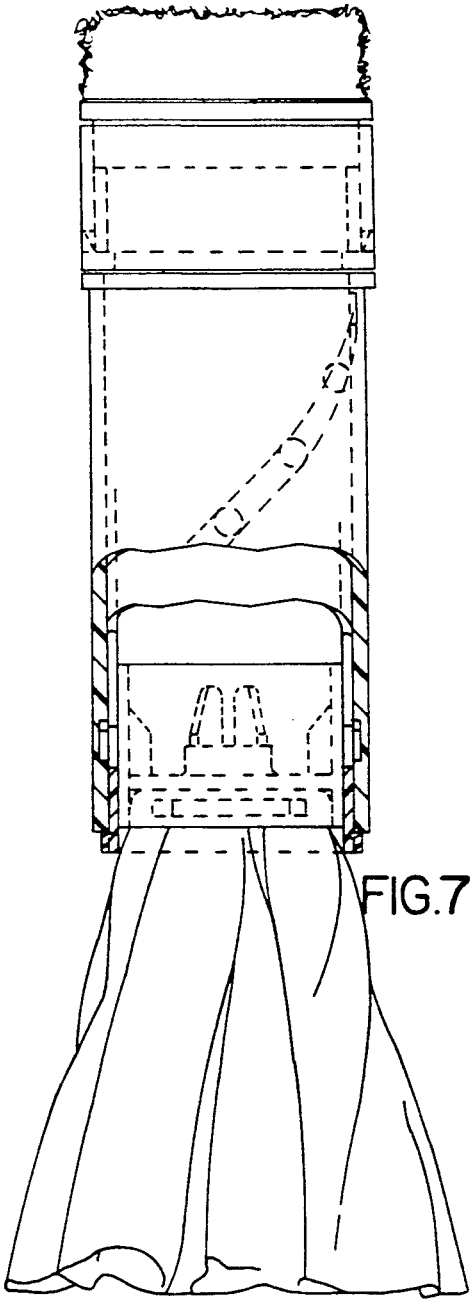
FIG.7
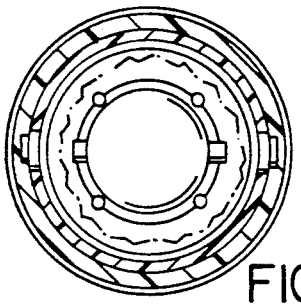
FIG.6

GOLF PLAYER'S PERSONAL GOLF BALL AND EQUIPMENT CLEANING IMPLEMENT

This is a continuation of copending application Ser. No. 07/363,273 filed on 05/31/89.

TECHNICAL FIELD

The present invention relates to, broadly, the game of golf and more particularly to an implement which is small and adapted to be carried by the player and secured to the garrment of the player or the golf bag, an implement for cleaning of a golf ball prior to a putting action on a golf green. As is known, golf courses have varying impediments and the arrangement is such that a ball after a player strikes the same on the golf tee, can run into circumstances either on the golf course terrain and/or varying conditions of weather, and the golf ball and implements such as a putter club and other clubs can become contaminated such as by mud or other material through which the golf ball is directed. Under such circumstances, accuracy of ball putting on a putting green can be seriously affected. The present invention permits a cleaning of the ball, golf clubs, and/or other instruments used in the golf game.

BACKGROUND OF THE INVENTION

The difficulties encountered in any game of golf can include any of the problems as set forth above. The present invention permits a player to compensate for problems occurring and to insure that a golf ball is accurately puttable on a green and the ball and other implements used in the game can be readily cleaned.

It is also known that golf games played under circumstances as, for example, golf tournaments or competitive golf must meet certain requirements as set forth in the rules of golf by USGA. Additionally, the present implement can include means for position marking of a ball on a green and include a clip for fastening the implement to the clothing of the golfer, and further this mounting can include a spur for club groove cleaning. Care must be taken that the implement does comply with these rules of golf although under some circumstances such as an amateur, weekend golfer, additional means can be incorporated for maintaining other members in the best condition for the game. The objectives of the present invention will be readily apparent from the preceding material. Additional objects and advantages will be hereinafter set forth with reference to a detailed discussion of the invention and components thereof.

OBJECTIVES OF THE INVENTION

The accompanying drawings illustrate preferred embodiments of the invention, and when taken together with the description, serve to explain the principles of the invention.

Figure 2:
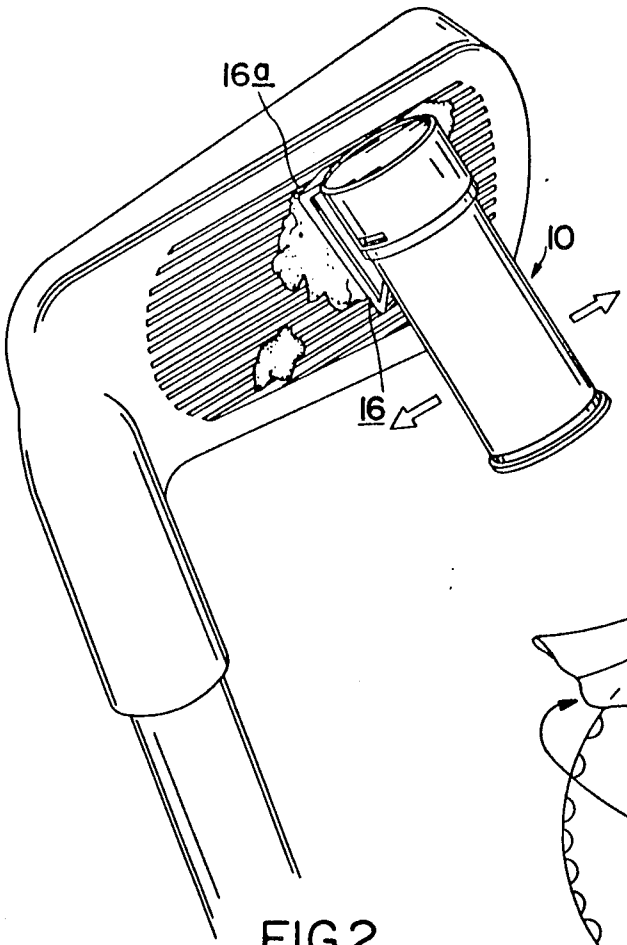
Figure 1:
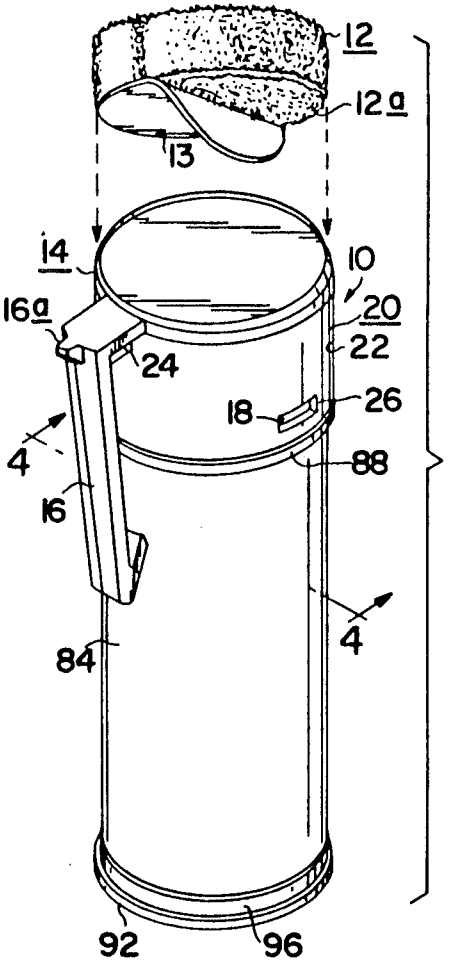

FIG. 1 - is an enlarged perspective view of the golf-ball composure scouring and cleaning, pocket clip-on, device of this invention;

FIG. 2 - is an enlarged side elevational view of the device shown in FIG. 1, utilizing a member to remove undesirable accumulations of foreign matter from the surface of a golf ball. A scouring member is not permissible under USGA rules and can be removed for different rules.

Figure 3:
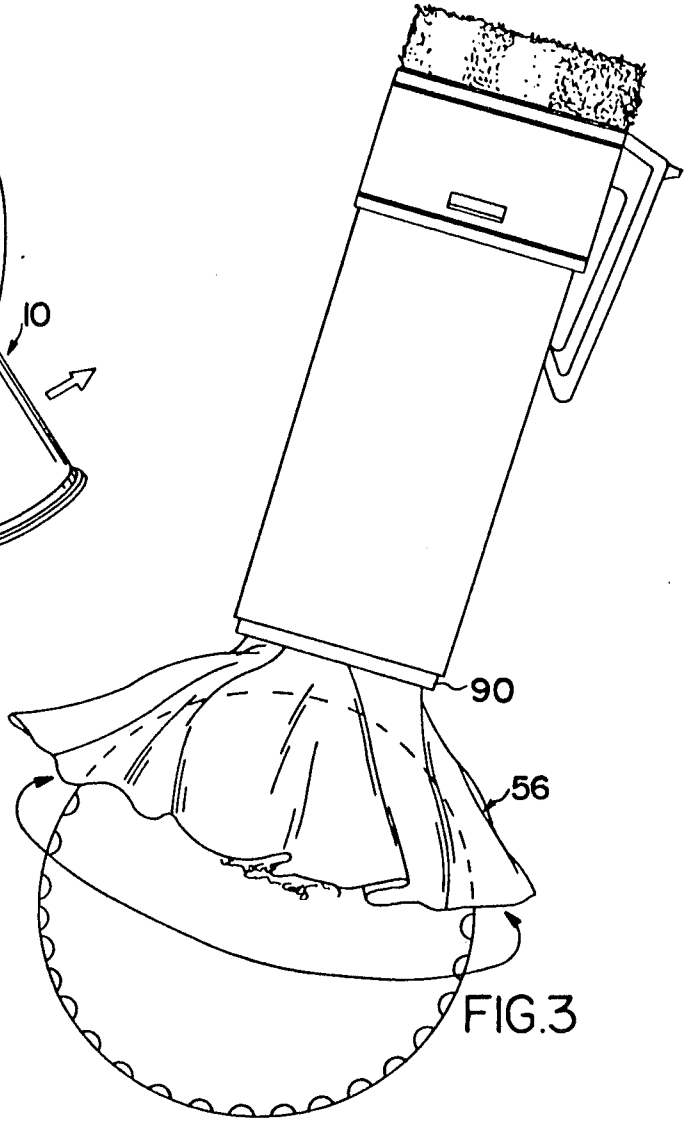

FIG. 3 - is an enlarged side elevational view of the device shown in FIG. 1 in a golf ball wiping or cleaning mode. A closure cap is removed and the wiping disk extended, the ball, shown in dot & dash outline showing wiping the surface of the ball.

Figure 9:
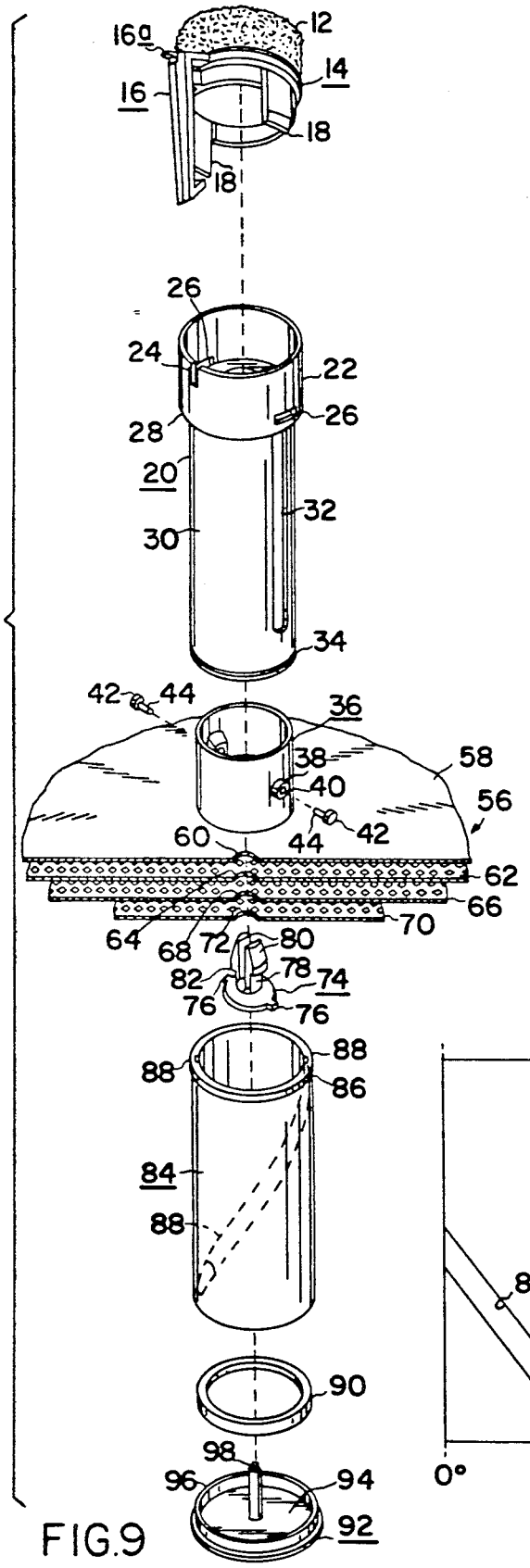
Figure 11:
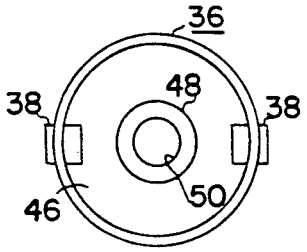
Figure 10:
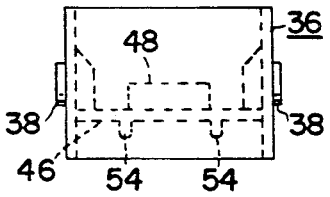
Figure 12:
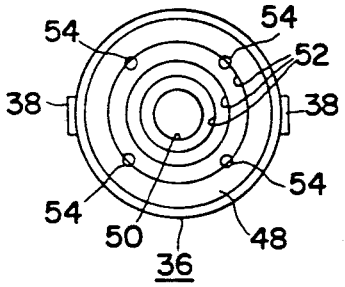
Figure 13:
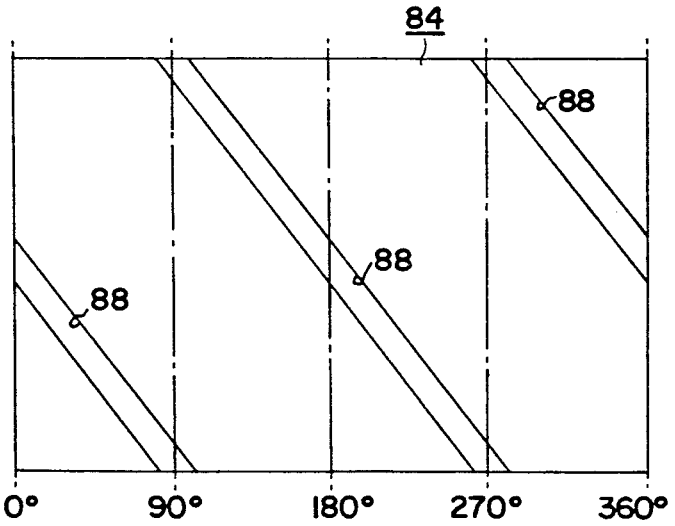

FIG. 4 - is an enlarged sectional elevational view of the device taken on the line 4,4 of FIG. 1;

FIG. 5 - is a plan view of FIG. 4 under use with a scouring member;

FIG. 6 - is a transverse sectional view taken on the line 6,6 of FIG. 4 showing additional details of construction and some of the details of the lower face of a traversing cylinder, the wiping disk, broken away in dot & dash outline;

FIG. 7 - is an enlarged side elevational view of the device having its lower portion broken away and in section showing the innermost cylinder in its lowermost position and its associated wiping pads or discs extended for use;

FIG. 8 - is a plan view of FIG. 7 showing the extent and direction of rotation, of the upper portion of the device, necessary to fully extend or retract the wiping disk;

FIG. 9 - is an exploded perspective view, illustrating all the component parts of the device, shown in FIGS. 1–8;

FIGS. 10–12 - are side elevational views, plan view and a bottom plan view of the innermost traversing cylinder, more clearly illustrating details;

FIG. 13 - is an interior development view of the outermost cylinder FIG. 9, showing clearly the two diametrically opposed interiorally disposed cam tracks.

Additional details will be more clearly referred to in the following description of an embodiment of the invention. It is to be understood that use of a scouring member as illustrated in most of the figures is for selective use, depending upon the game being played. In this connection, the USGA will not permit any phase or portion of a structure from disfiguring of a golf ball. This pad can be included in a kit for general public use or omitted under certain game restrictions. The description is to be understood in this regard since the scouring pad is not a necessary portion of a ball cleaning implement permissible under USGA rules. However, this disc can be made of such a material as to facilitate ball or club cleaning and have a consistency which would not disfigure the ball.

For some uses, this pad could consist of a soft brush or sponge material, it being understood that the rules of a particular game are subject to elimination of this member. A soft brush or bristles can be used to help clean club heads having such as recessed lines or grooves and may even be used on a golfer's shoe to remove material from around the cleats thereon for enhanced functioning.

Referring now more specifically to the drawings, the pocket clip-on self-contained small ball cleaning and wiping device are set forth at 10. The truncated pad is designated 12, it being understood that this is not used under certain game circumstances. A downwardly extending clip member is shown at 16 attached to the upper end of the implement and having at **16*a* a club head groove cleaning spike. Use of this cleaning spike is shown in greater detail in use in FIG. 2** of the drawings.

When a pad (12) is to be used, a self-adhering feature utilizing an adhesive carrying disc (13) is attachable to the bottom (**12*a*) of the pad as shown in FIG. 1 and a raised edge at 14 can be used for locating and affixing this pad. While the pad (12**) is shown in most of the figures, it is to be understood that this can be ommitted for circumstances requiring compliance with rules of the game being played.

A downwardly extending clip member (16) is shown in mounted position in the drawings.

In the downwardly extending cap, two locking members (18) are utilized.

The inner rotatable cylindrical sleeve (20) it is mounted within the outer casing (10) while a co-axially extending larger diameter upper cap portion is shown at 22.

A slot is provided at 24 in the upper circumferential end for insertion and mounting of clip (16). Two diametrically opposed ports or openings are utilized for engagably arranging the locking tabs on the cap. A mounting shoulder is shown at 28 and a smaller diameter co-axially extending lower cylindrical portion is designated at 30. The diametrically extending slots are formed in this lower cylindrical portion. A circumferentially extending groove is positioned adjacent the lower terminal end of the cylindrical sleeve. An innermost axially aligned and axially transversing cylinder (36) is shown in FIGS. 9, 11. Two diametrically opposed integrally formed bosses is positioned as shown at 38. Referring to FIG. 9, which discloses a great number of the portions of the device includes two diametrically opposed integrally formed bosses, and this member 38 includes bore (40) therein. Two metallic cam followers (42) have integrally formed stub shafts (44).

An intermediate circumferentially extending web portion (46) is utilized in conjunction with a centrally located upwardly directed hub member (48). As shown at 50, there is positioned an axially extending bore through the hub. Circumferentially extending an axially aligned plurality, a ball wiping disc assembly is generally indicated at 56 in FIG. 9. This structure of the disc member has an outermost disc of thin plastic whose purpose is to prevent wetting of golfer's hand glove or hand. The discs, of which there are several, have a centrally located hole (60) therethrough. The function of these holes will be explained in greater detail hereinafter. Actually, the cloths are manufactured by Johnson & Johnson, under the names Chicopee or Tee Towel. The adhesive pad referred to previously is manufactured by 3M, category #7413 Scotch Brite. As mentioned, the plastic liner positioned under the three cloths prevents cloth moisture from wetting the golfer's glove. The cloths and plastic are cut in graduated circles from 2½ to 3½ inches in the embodiment shown and are attached to a cylinder with a pointed button-type snap.

A snap-in, non-rotating retaining button is generally designated (74) and having two diametrically opposed bosses thereon. A centrally located bifurcated upwardly directed cylindrical stem portion is shown at 78 and mounted thereabove are truncated conically shaped upper terminal ends (80). There is a shoulder (82) formed by the cylindrical stem and adjacent conical tip. The upper terminal ends (80) are adapted for insertion through the central holes in the discs for mounting of the same.

There is an outermost axially aligned cylinder (84). This member has a circumferentially extending flange (86).

Schematically shown at 88 are two integrally formed, diametrically opposed cam tracks. The alignment and positionment of these cam tracks is more clearly shown in FIG. 13. Functionally, the bosses (76) coact with the cam tracks whereby, upon rotation of the outermost axially aligned cylinder (84) the bosses, by coaction within the cam tracks, will serve upon rotation of the lower cylindrical member, to either extend the discs outwardly from the upper end of the device into the positions shown in FIGS. 3 and 4, in which position a ball shown in dotted lines in FIG. 3 can be intercoactively cleaned by the disc's material and after such ball cleaning, opposite rotation of the downward member will retract the discs to a position within the cylinder as shown for example, in FIG. 4. A snap ring (90) at the lower end serves to selectively retain an end cap (92) which serves as a closing base and end cap. A solid disc shaped base (94) is provided in this closure cap member, facilitated by an integrally formed, axially aligned, circumferentially extending ring (96), in conjunction with the remainder of the device and can be removed has the spike (98) insertable within the lowered and/or retracted discs. The function of the member 92, 94, 96 and 98 also constitute all marking indicators as is obvious to those in the art. The spike, being inserted within the retracted disc serves also as the end closure member.

It will, therefore, be understood that a rotation will serve to either extend or retract the cleaning discs for cleaning of the golf ball.

The present invention overcomes difficulties encountered in some instances on golf courses and the towel or cleaning disc on the individually carried member can serve to wash or cleanse the ball and yet this member is or can be fit within a user's pocket. The device shown in the drawings and explained hereinbefore consequently serves a very important function to a golfer.

The towels can be replaced with new ones by simply pushing in the tabs through the two openings with a small pointed object and the bottom will thereupon release. A long-nosed plier can then be used to squeeze the tabs together and push in to pop out the old towels. The present invention accordingly provides a very handy and usable ball and/or implement cleaning device which can be personally carried by a golfer.

While a preferred embodiment has been hereinbefore described, obviously minor changes can be effected in the device without departing from the spirit and scope of the invention.

What is claimed is:

1. A device for cleaning an object such as a golf ball, comprising;

inner and outer cylinders mutually supported for rotation with respect to each other about an axis, said inner cylinder having a portion extending below said outer cylinder to provide surfaces on said cylinder to permit relative rotation with respect to one another upon twisting of said inner cylinder portion;

a cleaner disc composite including a plurality of cleaning discs mounted with said inner cylinder on a central carrier member forming part of said composite, said inner cylinder having two integrally formed and diametrically exposed cam tracks to operably mount said central carrier member and operable with said cam tracks upon rotation of said carrier member to extend or retract said plurality of cleansing discs between a retracted position nested in said chamber and an extended ready to use position, said cleaning discs consisting of generally circular shape members of various diameters and including cotton strands and interwoven plastic strand for increased life and effectiveness, said discs being in a stacked relationship with a larger disc positioned in the uppermost position and the lowermost discs being of smaller diameter to facilitate formation of said retracted position, the outer disc forming a water impervious shield to retain moisture while in said retracted position and protect the hand of the user from moisture when in the ready to use position;

said discs having centrally openings therethrough and being operatively mounted within the inner cylinder by a snap-type holder for insertion through said openings in said discs to fasten said discs and prevent rotation of said discs with respect to said inner cylinder;

said device also including diametrically opposed bosses operationally mounted with respect to said inner cylinder, and operation in conjunction with said opposed cam tracks serving to extend or retract the cleaning discs mounted thereon;

said inner cylinder further including locking means at its upper end to lock said outer cylinder thereon and further including a closing disc member having an upright peg thereon, said closing member being usable as a ball positioning indicator on a golf green, said device further including a mounting clip on the exterior and said mounting clip including a golf head groove cleaning spike extending therefrom.

* * * * *